United States Patent [19]

Stone

[11] Patent Number: 4,501,222

[45] Date of Patent: Feb. 26, 1985

[54] APPLICATOR FOR FISHING LINE DRESSING COMPOSITION

[75] Inventor: David A. Stone, Glide, Oreg.

[73] Assignee: Stone Fly Products, Glide, Oreg.

[21] Appl. No.: 534,388

[22] Filed: Sep. 21, 1983

[51] Int. Cl.[3] ..... B05C 1/06

[52] U.S. Cl. ..... 118/234; 118/269; 43/25

[58] Field of Search ..... 118/234, 269; 43/54.1, 43/25

[56] References Cited

U.S. PATENT DOCUMENTS

| | | | |
|---|---|---|---|
| 206,414 | 7/1878 | Beach . | |
| 686,461 | 11/1901 | Keats . | |
| 771,546 | 10/1904 | Harding et al. . | |
| 977,466 | 12/1918 | Mortimer . | |
| 2,022,091 | 11/1935 | Scharnhorst . | |
| 2,490,650 | 12/1949 | Reckler . | |
| 2,988,043 | 6/1961 | Sassenberg | 118/234 X |
| 3,874,332 | 4/1975 | Meinal . | |
| 4,237,641 | 12/1980 | Gupton | 43/25 |
| 4,290,223 | 9/1981 | Ostenberg et al. | 43/54.5 R |

FOREIGN PATENT DOCUMENTS

| | | | |
|---|---|---|---|
| 880504 | 10/1961 | United Kingdom | 118/269 |

*Primary Examiner*—John P. McIntosh

*Attorney, Agent, or Firm*—Cushman, Darby & Cushman

[57] ABSTRACT

The applicator is provided in the form of a hinged box-like shell of somewhat flexible inert plastic material having opposite end walls which are slotted in an off-center manner. The body and lid of the shell each removably receive applicator pads, e.g. of absorbent material such as wool felt on which the user may apply a fishing line dressing composition. In use, the applicator is closed about a fishing line so that the line is in contact with both body and lid pads, and the segment of the line that is to be dressed is moved longitudinally relative to the applicator as compressive finger pressure on the opposite face walls of the shell is used for modulating squeezing of the line. The non-hinged sidewall of either the body or the lid is provided with a catch-equipped flange which overlaps the comparable wall of the other of the lid or the body. And the two end walls of the other of the lid and the body, are provided with slotted flanges which overlap the comparable walls of the body or the lid. Preferably the slots, which function as positioning guides for the line are displaced laterally from the median of the shell and the shell length is a multiple of its width, so that the applicator pads may be reversed, inverted and shifted in order to maximize their useful life.

18 Claims, 4 Drawing Figures

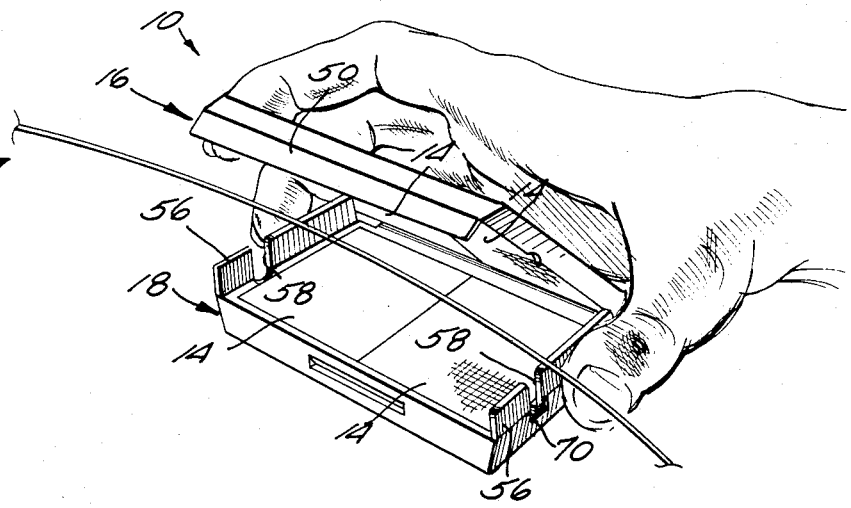
Fig. 1
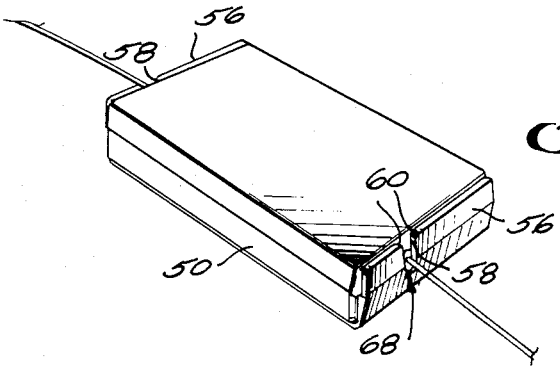
Fig. 2
Fig. 4
Fig. 3
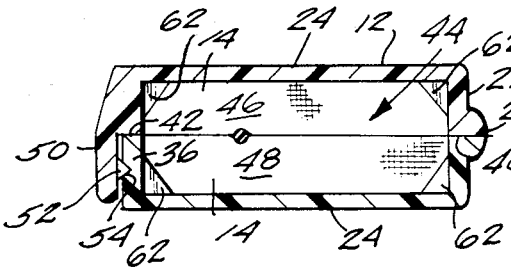
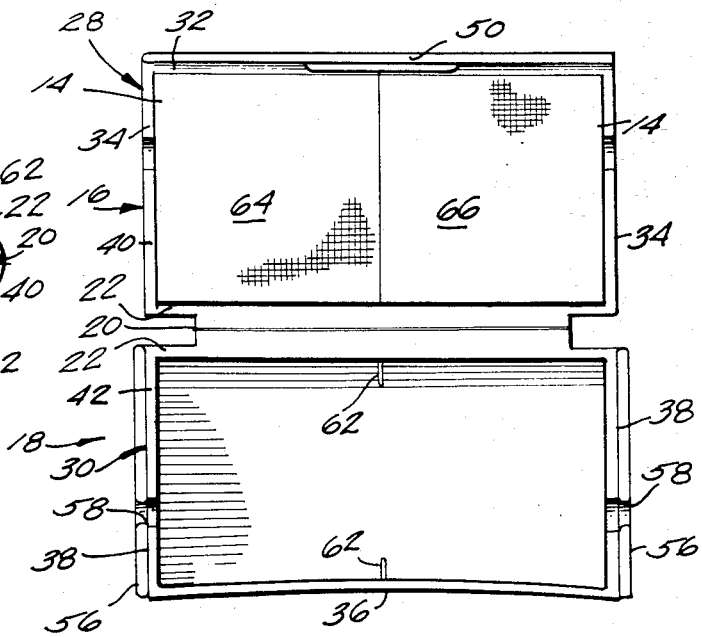

APPLICATOR FOR FISHING LINE DRESSING COMPOSITION

BACKGROUND OF THE INVENTION

The present inventor is aware of a product currently on the market, named "Mono-Slick", by Maxima. This product, as its name suggests, is designed for use on monofilament fishing line which is used for spin fishing and for bait fishing, but rarely is used by fly fishermen. The Mono-Slick product is a unidirectional tool with a series of chambers through which the monofilament line must be successively drawn. (If the line is pulled backwards, it will emerge with an excess of line dressing solution on it.) This tool is designed for dressing the entire length of a monofilament line at once, in a hands-off operation. That is, the Mono-Slick applicator is intended to be placed on the monofilament line between guides on the fishing rod, and the fishing reel wound in one direction to pull the entire length of the monofilament line through the applicator.

In contrast with the uniform diameter that monofilament fishing line has for use in bait fishing and reel fishing, it is customary for fly fishing lines to incorporate many different diameters of the length of a single line. The taper or change in diameter is what gives a fly fishing line its casting abilities and characteristics. Accordingly, for properly cleaning and dressing a fly fishing line, an applicator is needed which, in contrast to the Mono-Slick applicator, can compensate for changes in the diameter of the line and can easily be used for treating selected portions of the line.

The present inventor is a fly fisherman who sees a problem with the products currently available for applying line dressing solution to fly fishing lines.

Most commonly the solution is sold with a pad. The user soaks some solution into the pad and folds the soaked pad about the line and pulls the line through the soaked pad. The problem is that the solution is sticky and water repellant and won't wash off the user's hands without soap. So if the user gets some on his or her hands when he or she is out fishing, it has to stay there until he or she gets back to where there is soap for washing.

In addition to the user's hands, face and clothing, the rod and the reel, sometimes sections of the fly line, the leader and often the fly itself should not be dressed with the dressing solution which is being applied to one or more other sections of the fly line.

Heretofore, the difficulty in selectively applying fly line dressing solutions, particularly hydrophobic ones, has limited the market for such solutions and consequently of applicators for them. A further consequence has been a limitation of the pleasure of fly fishing. And for those who choose not to use fly line dressing solutions due to the abovementioned problems, the consequence has been fly lines which have not floated properly or cast properly, and fly lines which have worn-out prematurely.

SUMMARY OF THE INVENTION

The applicator is provided in the form of a hinged box-like shell of somewhat flexible inert plastic material having opposite end walls which are slotted in an off-center manner. The body and lid of the shell each removably receive applicator pads, e.g. of absorbent material such as wool felt on which the user may apply a fishing line dressing composition. In use, the applicator is closed about a fishing line so that the line is in contact with both body and lid pads, and the segment of the line that is to be dressed is moved longitudinally relative to the applicator as compressive finger pressure on the opposite face walls of the shell is used for modulating squeezing of the line. The non-hinged sidewall of either the body or the lid is provided with a catch-equipped flange which overlaps the comparable wall of the other of the lid or the body. And the two end walls of the other of the lid and the body, are provided with slotted flanges which overlap the comparable walls of the body or the lid. Preferably the slots, which function as positioning guides for the line are displaced laterally from the median of the shell and the shell length is a multiple of its width, so that the applicator pads may be reversed, inverted and shifted in order to maximize their useful life.

The principles of the invention will be further discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

In the Drawing:

FIG. 1 is a perspective view of a preferred embodiment of the applicator having been opened by and being held in the fisherman's one hand, line dressing composition having been added to the pads, and the applicator being about to be closed about a section of a fly fishing line that is to be dressed;

FIG. 2 is a similar perspective view of the applicator, but showing it closed about the line;

FIG. 3 is a transverse cross-sectional view of the applicator closed about the section of line, this view being taken substantially on line 3—3 of FIG. 2; and FIG. 4 is an interior plan view of the applicator opened out flat about its integral hinge, and with both removable applicator pad units on one half of the shell removed, i.e. in the course of reversal, exchange, replacement or the like.

DETAILED DESCRIPTION

A preferred embodiment of the applicator of the invention is illustrated at 10. It preferably includes an integral shell 12 and a plurality of removable applicator pads 14. To give an appreciation of scale, the applicator 10 of the preferred embodiment may have approximately but somewhat smaller than the size, and have proportions of the familiar plastic or paperboard boxes in which twenty 35 mm photographic slides are customarily returned from photo-processors in two side-by-side stacks of ten slides. In fact, it may be injection molded of the same somewhat flexible plastic materials, e.g. polyethylene, polypropylene, polyethylene terephthalate or the like used in the manufacture of such photographic slide boxes, and preferably includes two similar halves 16, 18 which preferably are integrally hinged, as at 20, along corresponding edges of corresponding sidewalls 22.

In this description, the shell-half 16 is arbitrarily referred to as a "lid" and the shell-half 18 is correspondingly referred to as the "body". In fact, either half could be uppermost, and the terminology should be understood as being equally applicable to the unit if inverted or reversed. With the foregoing in mind, it will be observed that each shell half has an outer face wall 24 or 26, e.g. a top wall and a bottom wall, which is perimetricaly bounded by a skirt 28 or 30.

In the preferred embodiment, the applicator is rectangular and substantially twice as long as it is wide so that each skirt 28 or 30 is made-up of four walls provided in two pairs of opposed walls. The lid, in addition to having a sidewall 22 which is hinged to the sidewall 22 of the body as aforesaid, has an opposite sidewall 32, and two opposite end walls 34. Similarly, the body, in addition to having a sidewall 22 which is hinged to the sidewall 22 of the lid as aforesaid, has an opposite sidewall 36 and two opposite end walls 38.

On each shell half, all of the skirt walls have in common an inner edge 40 or 42 which preferably is planar. And, as is illustrated in FIG. 4, when the shell is fully open, e.g. in the condition in which it was originally molded, the edges 40 and 42 of both shell halves lie in a common plane.

When the shell halves 16, 18 are closed about the hinge 20, the edge 40 abuts the edge 42 about the whole perimetrical extent of each, thus enclosing an internal cavity 44, including a first compartment 46 comprising the half of the cavity 44 which is in the lid of the shell and a confronting second compartment 48 comprising the half of the cavity 44 which is in the body of the shell.

As shown, on one the shell halves, e.g. the lid, the non-hinged sidewall 32 is extended beyond the edge 40, in an externally overlapped manner by an integral flange 50 which, in the preferred embodiment, extends nearly from end to end of the shell and, when the shell is closed, nearly to the outer face of the opposite half of the shell, so as to substantially overlappingly cover the opposite sidewall 36 of the opposite half of the shell. This overlapping flange 50 is shown provided on its internal face with a protuberance 52 which resiliently snappingly fits into a corresponding recess 54 provided on the overlapped sidewall 36 for releasably latching and maintaining the shell in a closed condition.

Also in the preferred embodiment, on the other of the shell halves, the two opposite end walls 38 are both provided with similar flanges 56 which extend beyond the edge 42 in an overlapping manner. These flanges extend substantially from side to side of the respective shell half and, when the shell is closed, nearly to the outer face of the other half of the shell, so as to substantially overlappingly cover the corresponding end wall 34 of the other half of the shell.

At a site which is laterally displaced toward one side of the respective half of the shell from its longitudinal median, each flange 56 is provided with a notch 58 which extends so deeply from its free edge 60 that it cuts slightly into the corresponding end wall 38, i.e. dips about 0.1 inch below the edge 42. Each notch 58 is, for instance, about 0.1 inch wide with fillets 60 to broaden it slightly at its mouth. At a comparable location, each end wall 34 is slightly notched to above the edge 40. Accordingly, when the shell is in a closed condition, it has two generally circular openings 68 of about 0.1 inch in diameter, one through each end of the shell, on a laterally offset axis, these openings both communicating with the internal cavity 44 at the interface of its two compartments 46, 48.

Each compartment 46, 48 preferably has a length which is an even multiple of its width, so that it may removably receive a plurality of squares of applicator pad material arranged edge to edge in a row in each respective compartment. If considered necessary or desirable, each compartment 46, 48 may be partly subdivided by intermediate walls 62 which are parallel to but of lesser extent than the end walls of the respective compartment. The intermediate walls 62, if provided, are located at applicator pad unit boundaries, for the purpose of aiding in properly locating and removably retaining the applicator pad units in the respective compartments.

In the preferred embodiment, the applicator pads 14 in each compartment are shown consisting of two square units 64, 66, sized together to occupy the full volume of the respective compartment, right up to the level of the respective edge 40 or 42.

The constituency of the applicator pad material may vary depending upon what type of dressing is to be applied. One preferred material will work well with many different types of liquid dressing solutions presently used for dressing fly lines, is wool felt.

Because the two compartments 46, 48 are the same size as one another, and because the applicator pads 14 are made up of individual square units 64, 66, typical dimensions for each unit are one and one-half inches square, by one-quarter of an inch thick. Each applicator pad unit may be replaced separately, or any two of them may be exchanged one for the other, any one may be flipped-over and its previously hidden face exposed, or it may be turned around in increments of ninety degrees. And because the openings 68 are off-center, as the applicator is used with its pad units in any one particular disposition, they will become dirtied and worn along a correspondingly offset axis, so that pad unit "rotation" can be used for maximizing useful life of the pads in the same sense that automobile tires can be exchanged one for another about a car and/or reversed, for equalizing wear.

The inventor presently prefers to provide the applicators 10 in a "clean" state, i.e. with nothing on the applicator pads, and to leave it to the user to put his or her favorite dressing on the applicator pads. However, applicators 10 could be sold packaged with one or more containers of dressing and/or with spare applicator pad units and/or the applicator pads could be pretreated with dressing, much in the same way that inking pads for rubber stamps are sometimes sold "clean", sometimes pre-inked, and sometimes packaged with a container of ink.

The present invention does not propose any new dressing composition. Rather, it may make use of dressing compositions now or hereinafter in use. Usually, the dressing will be a fairly low-viscosity liquid which is capable of soaking into, e.g. being absorbed by, the material of the absorbent pads, although thicker and/or less well absorbed compositions which stay predominantly on the exposed surface of the absorbent pads may be used. Typically used in fly line dressing are non-aqueous solutions of hydrophobic (water-repelling) material which, when applied to the fishing line helps to make that portion of the fishing line float on the surface of the lake or other body of water, and/or to help to maintain the line straight, to improve its casting characteristics and/or to lubricate and protect it so that it will have a long and useful life.

In use, the applicator is carried to the fishing site in a closed condition. If it already has some dressing pre-applied to its pads, the closed nature of the applicator will prevent the user's container of fishing equipment from becoming contaminated with dressing, and will keep the applied dressing fresh and ready for use provided not a long time has elapsed since the user's last fishing experience. When the applicator is to be used, it is opened, preferably using the one-handed technique shown in FIG. 1, where the user uses slight compressive pressure on the two end wall flanges on the one shell half while simultaneously pulling on the flange on the free sidewall on the other shell half in a sense to dislodge the catch protuberance from the detent recess and rotate the shell halves open about the integral hinge.

If the applicator pads need to have some dressing put on then, some dressing is applied to at least one of the units, along the axis passing between the openings through the end walls of the applicator.

Then fishing line, e.g. the fly line, within the segment thereof to which the user wishes to apply dressing is placed along the treatment axis, in the two grooves in the end wall flanges, and the applicator is shut and latched, so that the segment of the line enters the applicator through the opening in one end wall, traverses both applicator pads along the laterally offset treatment axis, and leaves the applicator through the opening in the opposite end wall of the applicator. The line segment is then moved longitudinally relative to the applicator whether by holding the line segment still and sliding the applicator along it, or by holding the applicator still and pulling the line segment through it, or by a combination of these techniques. The relative movement may be in one direction, one pass or in both directions with two or more passes. By modulating the amount of compressive force that he or she applies to the opposite face walls of the applicator while the line segment is longitudinally moved relatively through the applicator, the user can adjust, regulate and modify the amount of dressing applied, the amount of dressing left on the line segment, the extent to which the line segment is longitudinally drawn out and straightened, and similar factors.

When the user is satisfied that the line segment has been satisfactorily dressed, he or she reopens the applicator, releases the line segment from within the notches, and recloses the applicator. The user is now ready to resume fly casting or his or her own favored fishing technique.

In order to maximize the life of the applicator, against the propensity of fishing line to cut into the material of the shell around the openings in the end walls of the applicator, the shell may be reinforced at these sites on the end wall flanges, e.g. by making the flanges externally thicker with bosses 70 at these sites, and/or by use of separately-made reinforcing liners (not shown) applied to the notches at these sites.

When, through use, the applicator pads have become contaminated, dirty, caked, worn, dried-out, non-absorbent, or covered with a non-desired dressing composition along the treatment axis, it is a simple matter to replace, rotate, exchange or flip-over the pads, in order to bring new, unused surface area into the treatment axis, a technique which is made easier and more productive by the fact that the treatment axis is laterally offset from the longitudinal median of the applicator.

While the size and shape of the applicator are as shown in the drawings and described above, other sizes and shapes are possible. And the applicator may be made part of some other structure, e.g. it may be formed in the lid of a container for the user's fishing equipment, or secured to a flap or web belt or the like of the user's clothing.

The applicator of the invention may be thought of as a line dressing tool. Whereas the principal use for which the applicator of the invention has been designed is to apply hydrophobic dressing composition to fly lines, it is recognized that substantially the same structure can be used for applying other dressings to fly lines, or to other fishing lines, or to other filamentary material.

It should now be apparent that the applicator for fishing line dressing composition as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. An applicator for applying a dressing composition to a segment of elongated flexible material such as a segment of fly fishing line, said applicator comprising:

a somewhat flexible plastic container wall means defining a shell enclosing a cavity when in a closed condition, said shell including two openable/closable shell halves each having internally disposed means defining a respective compartment; the two shell halves, when closed, having the two respective compartments arranged in confronting relation to provide said cavity;

the said container wall means of each shell half including an outer face wall and a perimetrically extending skirt wall means;

means hinging one of said shell halves to the other of said shell halves so that said shell may be closed and opened up along an imaginary plane which splits said cavity into said compartments;

each said compartment being constructed and arranged to removably receive an applicator pad constituted by at least one respective applicator pad unit positionable in at least two positions achievable by at least one of:

removing the applicator pad, turning it through part of a circle about an axis that is parallel to its thickness direction and re-inserting it in the respective compartment, shifting it rectilinearly from one site to another in the compartment, and removing it, flipping it over and re-inserting it in the respective compartment, with each said applicator pad substantially filling the respective compartment and having a working face disposed in said plane;

means defining two perimetrically widely-spaced openings through the shell on an axis lying in said plane, each said opening being provided in at least one of said skirt wall means, said axis being laterally offset in said plane from one which would divide said compartments into respective identically sized and shaped halves; and means defining a generally U-shaped guide mounted externally on one of said skirt wall means, each such guide including two sidewall means respectively bracketing a respective said opening, in a flanking sense, and crossing and extending a substantial distance past said plane, so that when said shell is opened, a segment of elongated flexible material which is to have a dressing composition applied thereto may easily be located on said axis in said plane when the compartments contain respective applicator pads, by placing a portion of the segment of elongated flexible material in the two respective U-shaped guides and closing the shell;

each shell half being molded of such flexible synthetic plastic material that, by modulating the compressive force that he or she applies to said outer face walls in a sense to squeeze the applicator while a line segment to be dressed is being longitudinally moved through the applicator, the user is able to adjust, regulate and modify the amount of dressing being applied to the line segment, the amount of applied dressing being left on the line segment and the extent to which the line segment is longitudinally drawn-out and straightened, even when the line segment being dressed is of graduating transverse cross-sectional area along its length.

2. The applicator of claim 1, wherein:

the shell is generally retangular shape in plan;

each said compartment having a length and width which are related in magnitude as a ratio of two small whole numbers.

3. The applicator of claim 2, wherein:

each compartment is twice as long as it is wide so that it can accommodate two applicator pad units which are square in plan.

4. The applicator of claim 3, further including:

an applicator pad removably received in the respective compartment of each shell half, each such applicator pad being constituted by at least one respective applicator pad unit positionable in at least two positions achievable by at least one of:

removing the applicator pad, turning it through part of a circle about an axis that is parallel to its thickness direction and re-inserting it in the respective compartment, shifting it rectilinearly from one site to another in the compartment, and removing it, flipping it over and re-inserting it in the respective compartment, with each said applicator pad substantially filling the respective compartment and having a working face disposed in said plane.

5. The applicator of claim 2, further including:

internal wall means on each shell half, within said compartment thereof; these internal wall means subdividing each compartment, partially through the thickness thereof, into a plurality of cells of substantially equal length and width, so that each may removably receive an applicator pad unit which is square in plan.

6. The applicator of claim 2, further including:

an applicator pad removably received in the respective compartment of each shell half, each such applicator pad being constituted by at least one respective applicator pad unit positionable in at least two positions achievable by at least one of:

removing the applicator pad, turning it through part of a circle about an axis that is parallel to its thickness direction and re-inserting it in the respective compartment, shifting it rectilinearly from one site to another in the compartment, and removing it, flipping it over and re-inserting it in the respective compartment, with each said applicator pad substantially filling the respective compartment and having a working face disposed in said plane.

7. The applicator of claim 1, wherein:

said hinging means is constituted by an integrally molded hinge; and said skirt wall means further include a first catch element molded externally on the skirt wall means of one of said shell halves; and a flange externally molded on the skirt wall means of the other of said shell halves and extending therefrom across and substantially beyond said plane in overlapping relation to said first catch element, there being means providing a second catch element which is complementary with said first catch element, said second catch element being disposed in an inwardly facing relation on said flange, for cooperative, releasable engagement with said first catch means.

8. The applicator of claim 7, wherein:

the one of said skirt wall means on which said guides are provided and the one of said skirt wall means on which said flange having said second catch element, are those on opposite ones of said shell halves, so that a user may open said shell with one hand, by holding both guides in an opposed manner slightly compressively between two or more spaced fingers on one hand and applying unlatching force against said flange having said second catch element, using at least one intervening finger on the same hand.

9. The applicator of claim 8, wherein:

each said guide is constituted by a respective flange formed on the respective skirt wall means in external overlapping relation to the respective skirt wall means of the respective other of said shell halves;

each such flange being deeply notched completely through the height thereof to provide as a notch the respective guide.

10. The applicator of claim 9, wherein:

the shell is generally rectangular shape in plan;

each said compartment having a length and width which are related in magnitude as a ratio of two small whole numbers.

11. The applicator of claim 10, wherein:

each compartment is twice as long as it is wide so that it can accommodate two applicator pad units which are square in plan.

12. The applicator of claim 10, further including:

internal wall means on each shell half, within said compartment thereof; these internal wall means subdividing each compartment, partially through the thickness thereof, into a plurality of cells of substantially equal length and width, so that each may removably receive an applicator pad unit which is square in plan.

13. The applicator of claim 1, further including:

an applicator pad removably received in the respective compartment of each shell half, each such applicator pad being constituted by at least one respective applicator pad unit positionable in at least two positions achievable by at least one of:

removing the applicator pad, turning it through part of a circle about an axis that is parallel to its thickness direction and re-inserting it in the respective compartment, shifting it rectilinearly from one site to another in the compartment, and removing it, flipping it over and re-inserting it in the respective compartment, with each said applicator pad substantially filling the respective compartment and having a working face disposed in said plane.

14. The applicator of claim 13, further including:

said hinging means is constituted by an integrally molded hinge; and said skirt wall means further include a first catch element molded externally on the skirt wall means of one of said shell halves; and a flange externally molded on the skirt wall means of the other of said shell halves and extending therefrom across and substantially beyond said plane in overlapping relation to said first catch element, there being means providing a second catch element which is complementary with said first catch element, said second catch element being disposed in an inwardly facing relation on said flange, for cooperative, releasable engagement with said first catch means;

the one of said skirt wall means on which said guides are provided and the one of said skirt wall means on which said flange having said second catch element, are those on opposite ones of said shell halves, so that a user may open said shell with one hand, by holding both guides in an opposed manner slightly compressively between two or more spaced fingers on one hand and applying unlatching force against said flange having said second catch element, using at least one intervening finger on the same hand.

15. The applicator of claim 14, wherein:

each said guide is constituted by a respective flange formed on the respective skirt wall means in external overlapping relation to the respective skirt wall means of the respective other of said shell halves;

each such flange being deeply notched completely through the height thereof to provide as a notch the respective guide.

16. The applicator of claim 15, further including:

a hydophobic fly fishing line dressing composition applied to at least some of said applicator pad units so as to be present along said axis in said plane.

17. An applicator for applying dressing solution to fishing lines, said applicator comprising:

a somewhat flexible plastic box integrally molded in two halves including a body and a lid with an integral hinge hinging the lid to the body along an edge of each;

each half of the box having an outer face wall and a perimetrical skirt wall, these skirt walls having said edges;

said edges being constructed and arranged to be in confronting relation in a plane substantially perimetrically of the box when the box halves are closed about said hinge;

said face wall and skirt wall of each box half defining an internal compartment of that box half;

an applicator pad removably received in the respective compartment of each box half, each such applicator pad being constituted by at least one respective applicator pad unit positionable in at least two positions achievable by at least one of:

removing the applicator pad, turning it through part of a circle about an axis that is parallel to its thickness direction and re-inserting it in the respective compartment, shifting it rectilinearly from one site to another in the compartment, and removing it, flipping it over and re-inserting it in the respective compartment, with each said applicator pad substantially filling the respective compartment and having a working face disposed in said plane;

one of said box halves having the skirt wall thereof provided at two perimetrically opposed sites spacedly flanking said hinge with respective external flanges which cross said plane and overlap with the skirt wall of the respective other one of said box halves;

there being means defining a deep notch in each said flange, so deep as to be based in the respective skirt wall on which said flanges are provided and thereby to define a respective opening into the interior of the box, these two openings being aligned on a treatment axis in said plane, said notches being laterally displaced from a median of the box;

each box half being molded of such flexible synthetic plastic material that, by modulating the compressive force that he or she applies to said outer face walls in a sense to squeeze the applicator while a line segment to be dressed is being longitudinally moved through the applicator, the user is able to adjust, regulate and modify the amount of dressing being applied to the line segment, the amount of applied dressing being left on the line segment and the extent to which the line segment is longitudinally drawn-out and straightened, even when the line segment being dressed is of graduating transverse cross-sectional area along its length.

18. The applicator of claim 17, further including:

a hydrophobic fly fishing line dressing composition applied to at least some of said applicator pad units so as to be present along said axis in said plane.

* * * * *